US010213802B2

(12) United States Patent
Kah, Jr.

(10) Patent No.: US 10,213,802 B2
(45) Date of Patent: Feb. 26, 2019

(54) PRESSURE REGULATOR IN A ROTATIONALLY DRIVEN SPRINKLER NOZZLE HOUSING ASSEMBLY

(71) Applicant: Carl L. C. Kah, Jr., North Palm Beach, FL (US)

(72) Inventor: Carl L. C. Kah, Jr., North Palm Beach, FL (US)

( * ) Notice: Subject to any disclaimer, the term of this patent is extended or adjusted under 35 U.S.C. 154(b) by 0 days.

(21) Appl. No.: 14/564,435

(22) Filed: Dec. 9, 2014

(65) Prior Publication Data

US 2015/0090809 A1 Apr. 2, 2015

Related U.S. Application Data

(63) Continuation-in-part of application No. 13/327,230, filed on Dec. 15, 2011, now Pat. No. 8,991,725.

(60) Provisional application No. 61/423,400, filed on Dec. 15, 2010.

(51) Int. Cl.

| | |
|---|---|
| ***B05B 3/04*** | (2006.01) |
| ***B05B 15/70*** | (2018.01) |
| ***B05B 1/30*** | (2006.01) |
| ***B05B 12/08*** | (2006.01) |

(52) U.S. Cl.

CPC ..... *B05B 15/70* (2018.02); *B05B 1/3006* (2013.01); *B05B 3/0422* (2013.01); *B05B 12/087* (2013.01)

(58) Field of Classification Search

CPC ..... B05B 3/0418; B05B 3/0422; B05B 3/045; B05B 7/12; B05B 15/10; B05B 1/3006

See application file for complete search history.

(56) References Cited

U.S. PATENT DOCUMENTS

| | | | | |
|---|---|---|---|---|
| 4,913,352 | A | 4/1990 | Witty et al. | 239/104 |
| 5,762,270 | A | 6/1998 | Kearby et al. | 239/205 |
| 5,779,148 | A | 7/1998 | Sareem et al. | 239/104 |
| 7,681,807 | B2 | 3/2010 | Gregory | 239/206 |
| 8,794,542 | B1 | 8/2014 | Hunter et al. | 239/240 |
| 2006/0278727 | A1 | 12/2006 | Kah, Jr. | 239/67 |
| 2011/0024523 | A1 | 2/2011 | Sesser et al. | 239/205 |

*Primary Examiner* — Darren W Gorman

(74) *Attorney, Agent, or Firm* — Amster, Rothstein & Ebenstein LLP

(57) ABSTRACT

A rotary sprinkler in accordance with an embodiment of the present disclosure includes a riser with a nozzle assembly rotatable mounted thereon. The nozzle assembly includes a pressure regulator and flow control element.

17 Claims, 15 Drawing Sheets

PRESSURE REGULATOR IN A ROTATIONALLY DRIVEN SPRINKLER NOZZLE HOUSING ASSEMBLY

CROSS-REFERENCE TO RELATED APPLICATIONS

The present application is a continuation-in-part of U.S. patent application Ser. No. 13,327,230 filed Dec. 15, 2011 entitled PRESSURE REGULATOR IN A ROTATIONALLY DRIVEN SPRINKLER NOZZLE HOUSING ASSEMBLY which claims benefit of and priority to U.S. Provisional Patent Application No. 61/423,400 entitled PRESSURE REGULATOR IN A ROTATIONALLY DRIVEN SPRINKLER NOZZLE HOUSING ASSEMBLY, filed Dec. 15, 2010, the entire content of each of which is hereby incorporated by reference herein.

BACKGROUND

Field of the Disclosure

The present disclosure relates to a rotating sprinkler including both pressure regulation and flow throttling provided in the nozzle assembly.

Related Art

The benefits of pressure regulation for sprinklers are well known to the irrigation industry such as discussed in the background sections of U.S. Pat. Nos. 4,913,351 and 6,997,393, the entire content of each of which is hereby incorporated by reference herein.

Pressure regulation is typically provided at an inlet in the base of the sprinkler as is described in U.S. Pat. Nos. 4,913,351 and 6,997,393, for example. As a result, in order to install or replace such pressure regulation elements, it is necessary to replace the entire sprinkler.

Accordingly, it would be desirable to provide a sprinkler that includes pressure regulation in the nozzle assembly to allow for easy installation and/or replacement.

SUMMARY

A rotary driven, i.e. water turbine, water driven ball drive, or water reaction driven irrigation sprinkler nozzle assembly in accordance with an embodiment of the present disclosure includes a pressure regulator preferably incorporated into the center of the nozzle assembly body and also includes a reference pressure chamber connected to atmospheric pressure with a biasing member enclosed to bias a movable pressure responsive member that is connected to an upstream pressure balanced flow throttling valve.

The sprinkler includes pressure regulation, flow throttling and flow shut off, if desired.

A sprinkler assembly in accordance with an embodiment of the present application includes a riser in fluid communication with a water supply including a flow path for water provided to the sprinkler assembly from the water supply, a nozzle assembly rotatably mounted on the riser and in fluid communication with the riser, the nozzle assembly including a center flow passage in fluid communication with the flow path of the riser, a nozzle mounted in the nozzle assembly and in fluid communication with the center flow passage, the nozzle configured to direct water out of the nozzle assembly, a pressure regulator provided in the nozzle assembly and configured to maintain a desired pressure at an inlet area of the nozzle and a throttling valve provided in the nozzle assembly and operably connected to the pressure regulator to selectively reduce flow to the nozzle when pressure at an inlet of the nozzle exceeds a reference pressure.

A nozzle assembly for use in a sprinkler assembly in accordance with an embodiment of the present application includes a riser in fluid communication with a water supply including a flow path for water provided to the sprinkler assembly from the water supply, a nozzle assembly rotatably mounted on the riser and in fluid communication with the riser, the nozzle assembly including a center flow passage in fluid communication with the flow path of the riser, a nozzle mounted in the nozzle assembly and in fluid communication with the center flow passage, the nozzle configured to direct water out of the nozzle assembly, a pressure regulator provided in the nozzle assembly and configured to maintain a desired pressure at an inlet area of the nozzle and a throttling valve provided in the riser and operably connected to the pressure regulator to selectively reduce flow to the nozzle when pressure at an inlet of the nozzle exceeds a reference pressure.

Other features and advantages of the present disclosure will become apparent from the following description of the invention, which refers to the accompanying drawings.

DETAILED DESCRIPTION OF THE EMBODIMENTS

Figure 1:
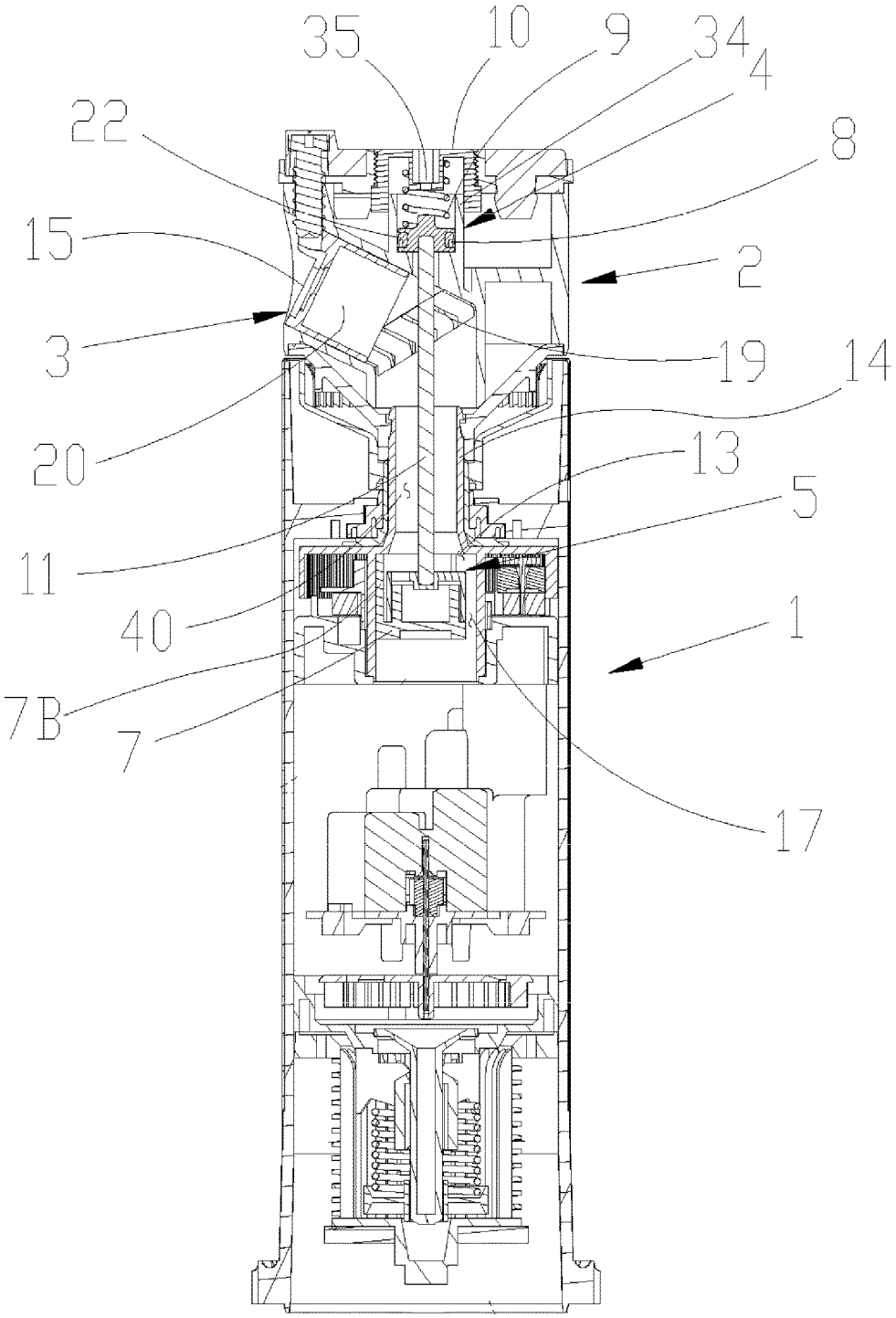
FIG. 1 shows a cross sectional view of a riser assembly and nozzle assembly of a typical water turbine driven sprinkler with a nozzle exit pressure regulator incorporated in the center of the rotating nozzle assembly.

FIG. 1 illustrates a cross sectional view of a riser 1 and a nozzle assembly 2 of a typical water driven gear drive sprinkler. The nozzle assembly 2 is rotatably mounted on the riser 1. The details of this type of sprinkler are generally described in U.S. Pat. No. 7,226,003, the entire contents of which are hereby incorporated by reference herein. A nozzle 3 is provided at the outlet of the nozzle assembly 2 to direct water out of the assembly. An exit pressure regulator 4 is incorporated on the center axis of the nozzle assembly 2. A nozzle drive shaft 14 is also provided on the center axis of the nozzle assembly 2.

Figure 4:
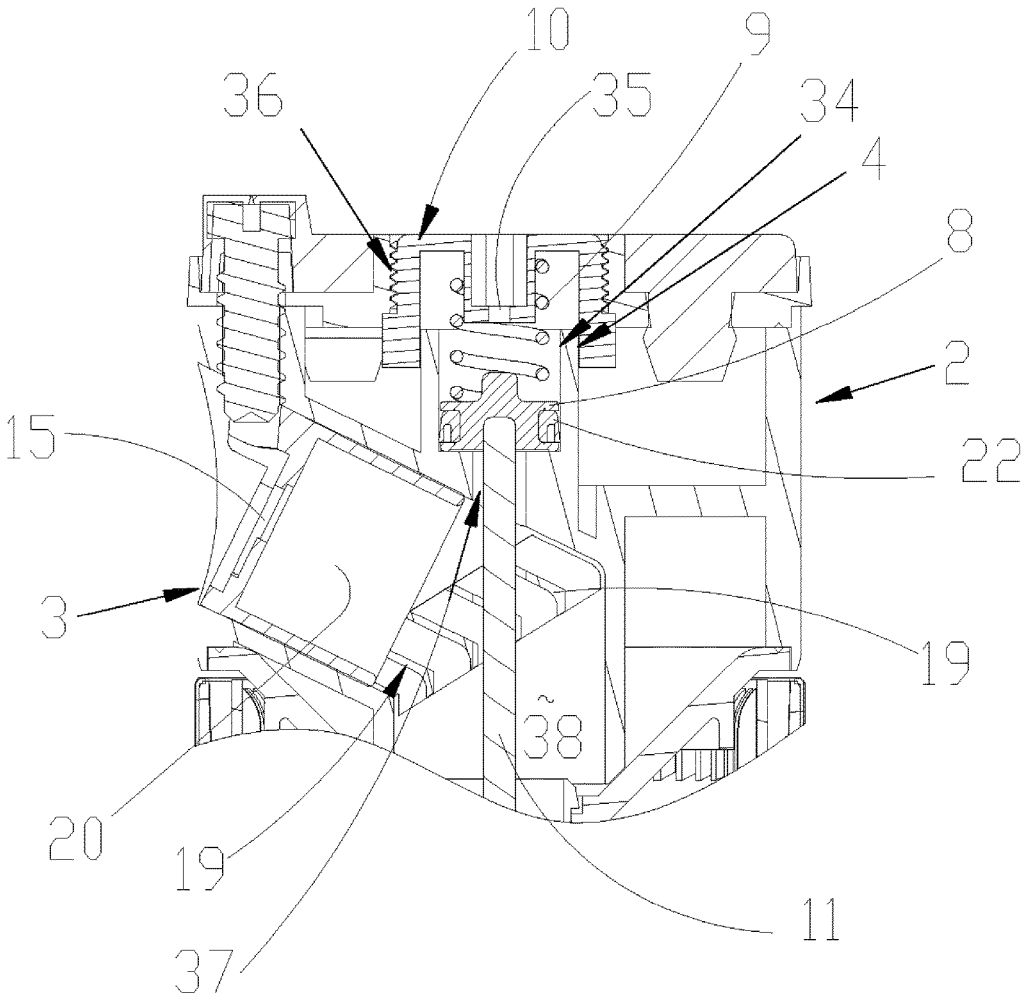
FIG. 4 is an expanded cross sectional line drawing of the upper rotating nozzle assembly of FIG. 1.

The pressure regulator 4 preferably includes a cylindrical chamber 34 with a pressure responsive member 8 slidably mounted for axial movement therein. See FIG. 4 also. A low friction sliding lip seal 22 may be provided between the member 8 and the sidewalls of the chamber 34. A bias spring 9 is housed in the pressure chamber 34 above the pressure responsive member 8 and biases the member 8 downward. Any suitable biasing member may be used in place of the bias spring 9. The chamber 34 is vented to the atmosphere at opening 35. Atmospheric pressure is the preferred reference pressure for the pressure chamber 34. If desired, an opening in the threads 36 may be used as an atmospheric vent instead of the separate opening 35.

The bias spring 9 may be preloaded by screwing the reference chamber top or cap 10 downwardly via the threads 36 to increase the preload of bias spring 9 against the top of the pressure responsive member 8.

Figure 3:
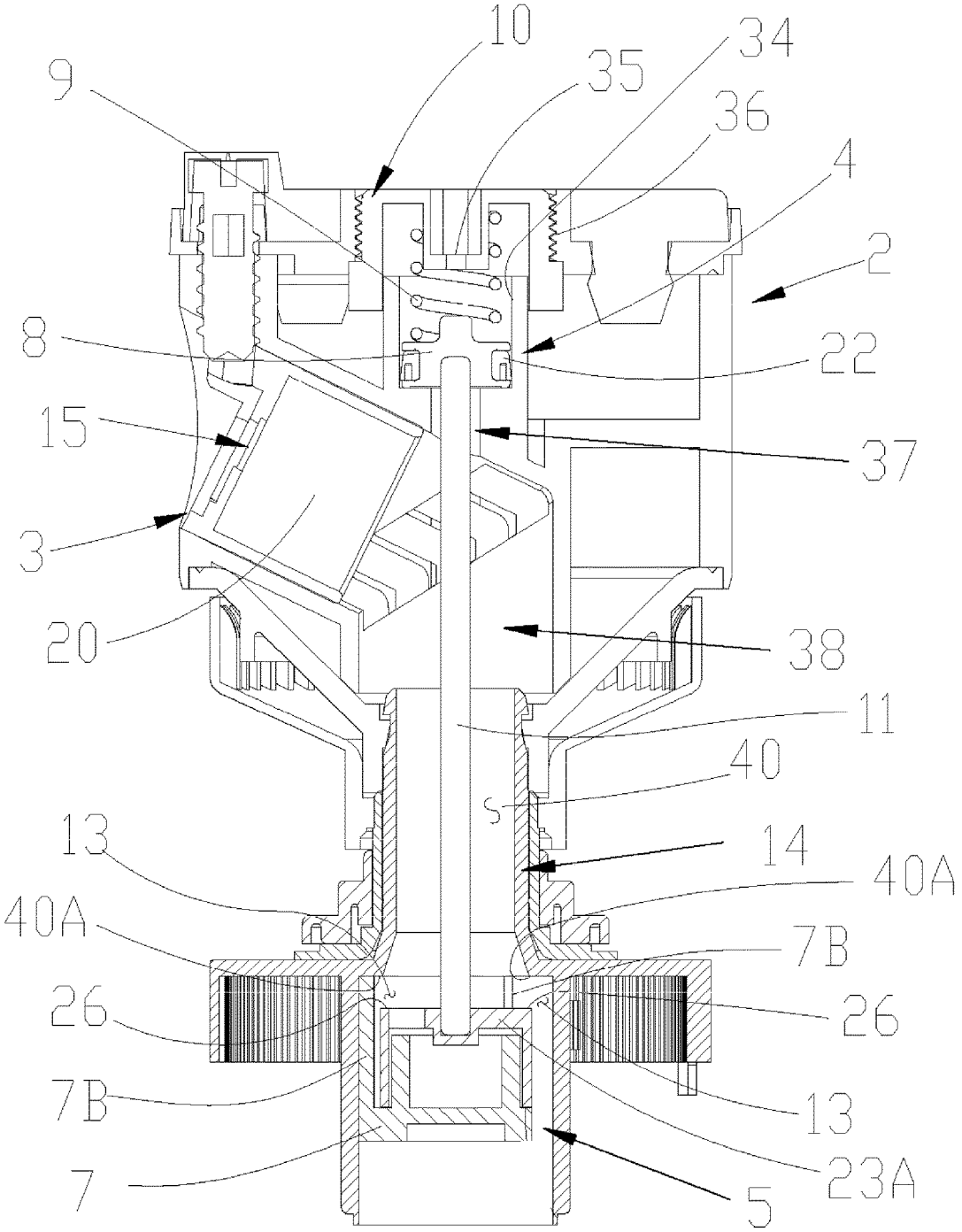
FIG. 3 shows a cross section of the rotating nozzle assembly of FIG. 1 including the drive shaft and a nozzle discharge pressure regulator mechanism.

Center hole 37 (See FIG. 3) below the pressure responsive member 8 opens into the center flow passage 38 (See FIG. 4) of the nozzle housing 2. The center flow passage 38 is connected by flow turning vanes 19 to the inlet area 20 of nozzle 3.

Figure 2:
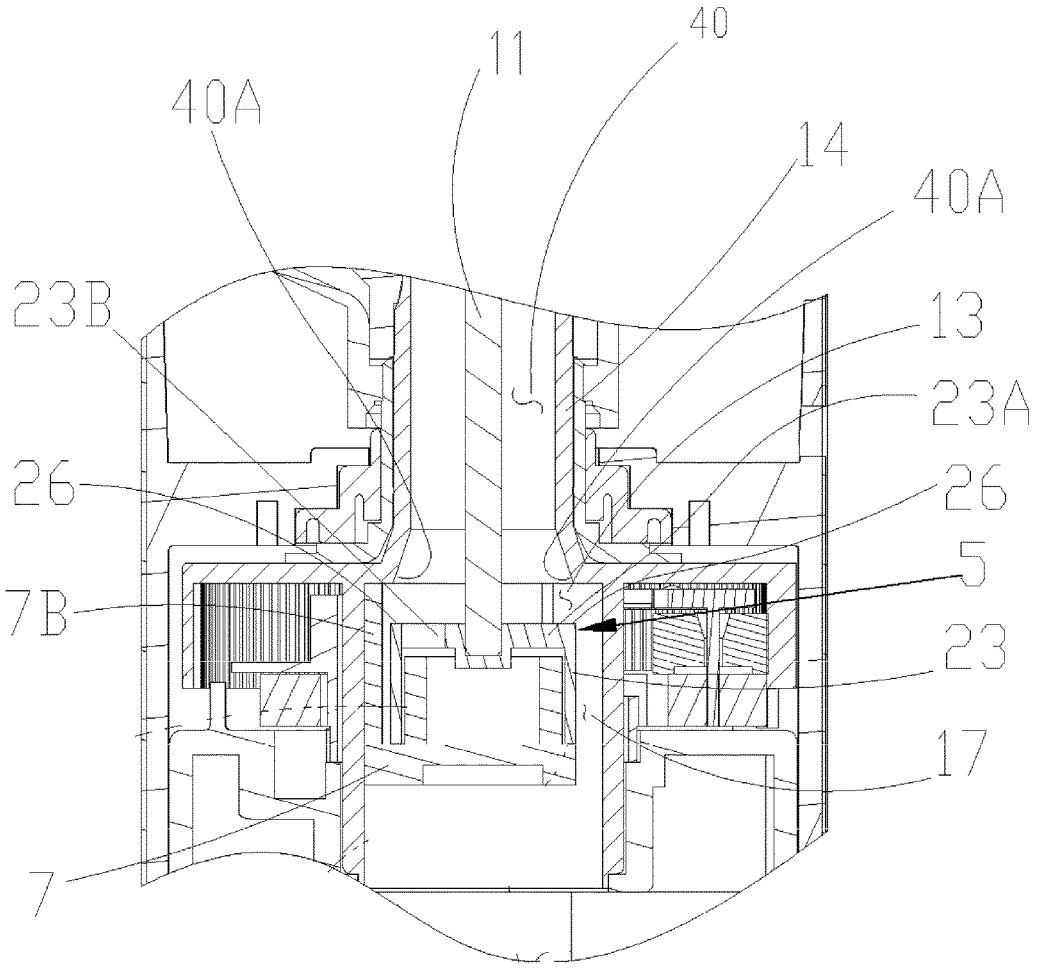
FIG. 2 shows an expanded view of the upstream pressure balanced flow throttling valve in the riser assembly of FIG. 1 which may also be used to throttle the range or shut off flow to the nozzle housing outlet passage where a changeable nozzle is shown installed in the exit side passage of the nozzle housing.
Figure 2A:
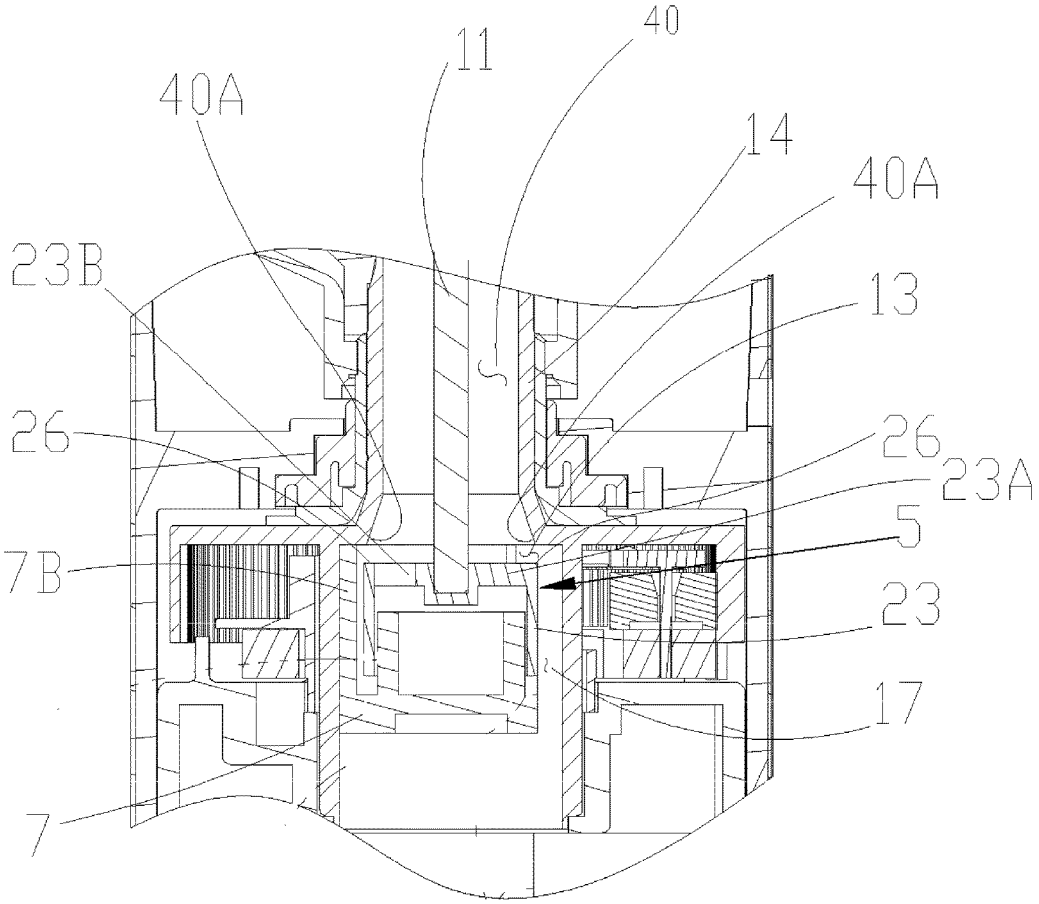
FIG. 2A illustrates the expanded view of FIG. 2 with the throttling valve restricting flow to the nozzle housing.
Figure 2B:
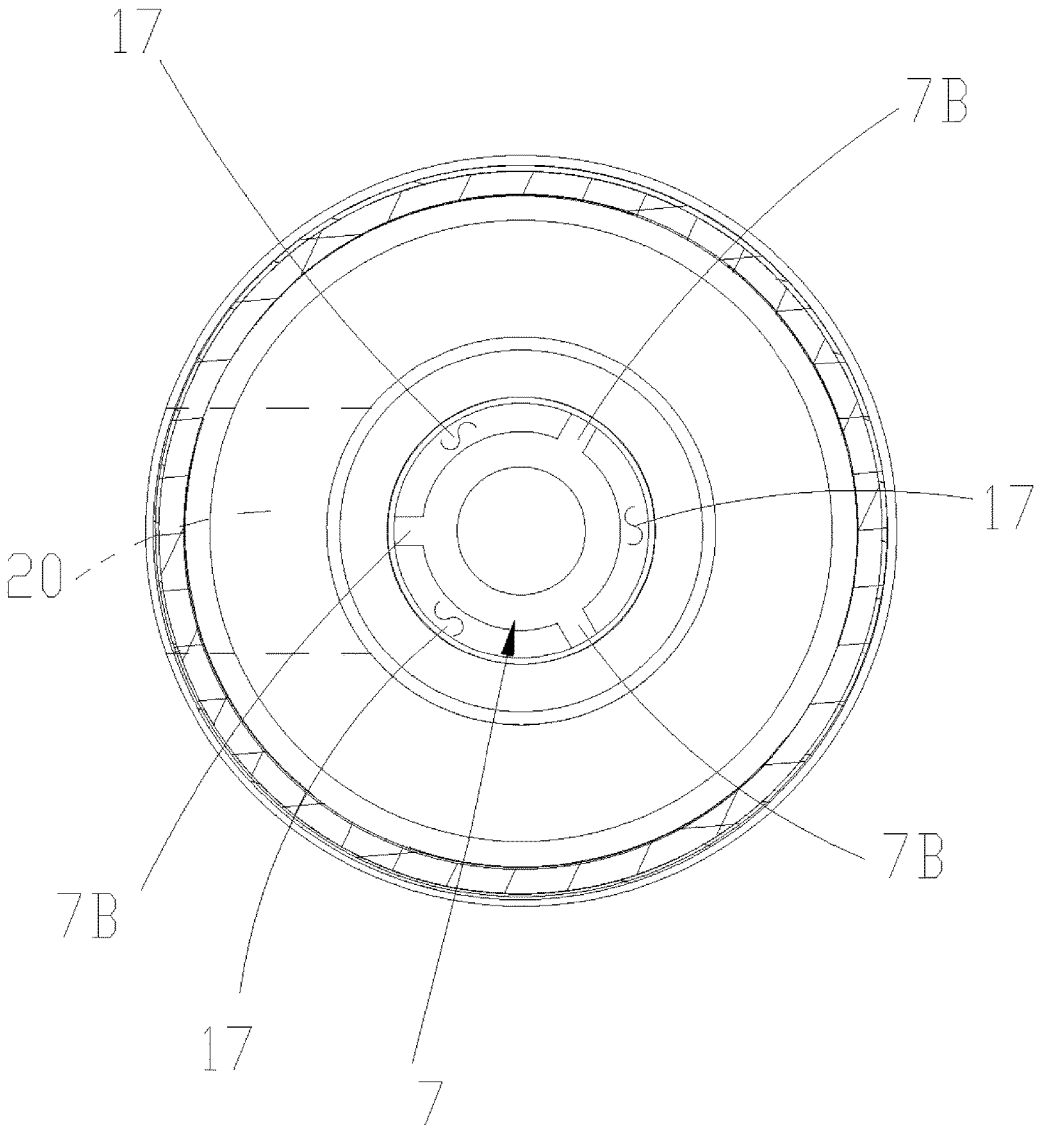
FIG. 2B illustrates a bottom view of the throttling valve of FIG. 2.
Figure 2C:
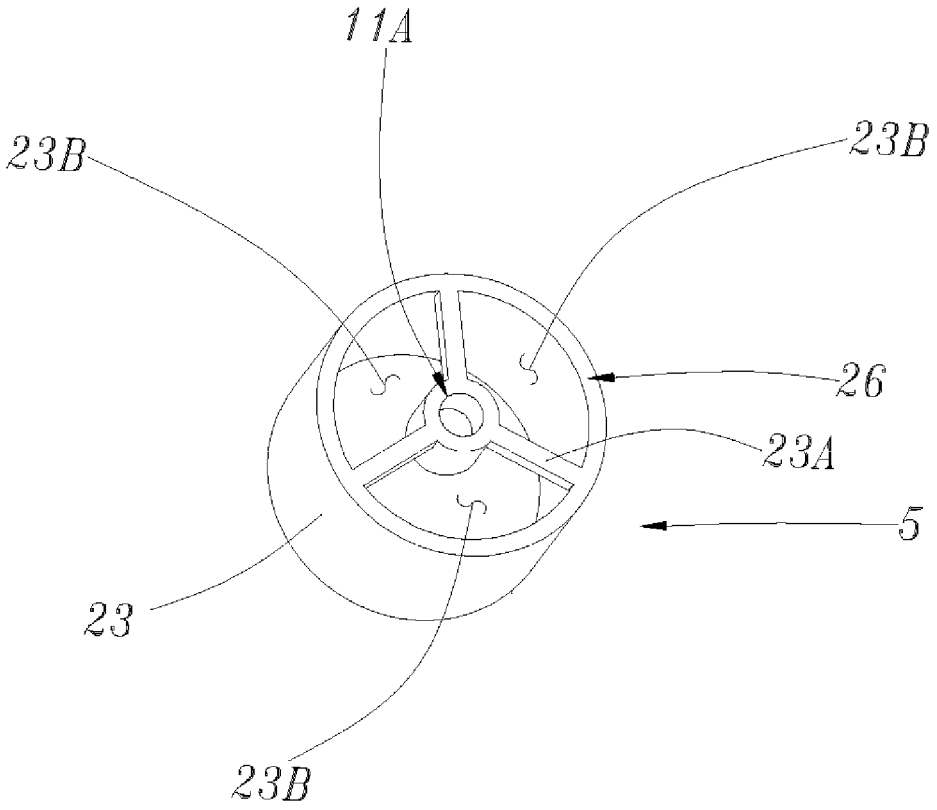
FIG. 2C illustrates the axially moving valve element of the flow throttling valve of FIG. 2.

As shown, the pressure responsive member 8 is preferably connected by shaft 11 to the upstream cylindrical flow throttling valve member 5 (see FIGS. 2A and 2C, for example). As the pressure at the inlet area 20 of the nozzle 3 rises above a desired level, which may be set by the preload of bias spring 9 on the pressure responsive member 8, the pressure responsive member will move upward against the force of the bias spring 9. This will lift the connecting rod 11 and the flow throttling valve member 5 as shown in FIG. 2A, for example. The flow throttling valve member 5 moves upward to reduce the circumferential flow area 13 that provides flow into internal flow area 40 of the nozzle drive shaft 14. The flow through the nozzle drive shaft 14 exits into the flow path area 38 of the nozzle housing 2 and then onward to the nozzle 3 where it passes through exit area 15 and out of the rotating nozzle housing 2. Reducing the flow area 13 reduces the flow of water into the area 40 and the flow area 38 such that the pressure at the inlet area 20 of the nozzle 3 is decreased as desired to maintain a substantially constant nozzle discharge pressure even for fluctuating or high inlet pressures.

Figure 2D:
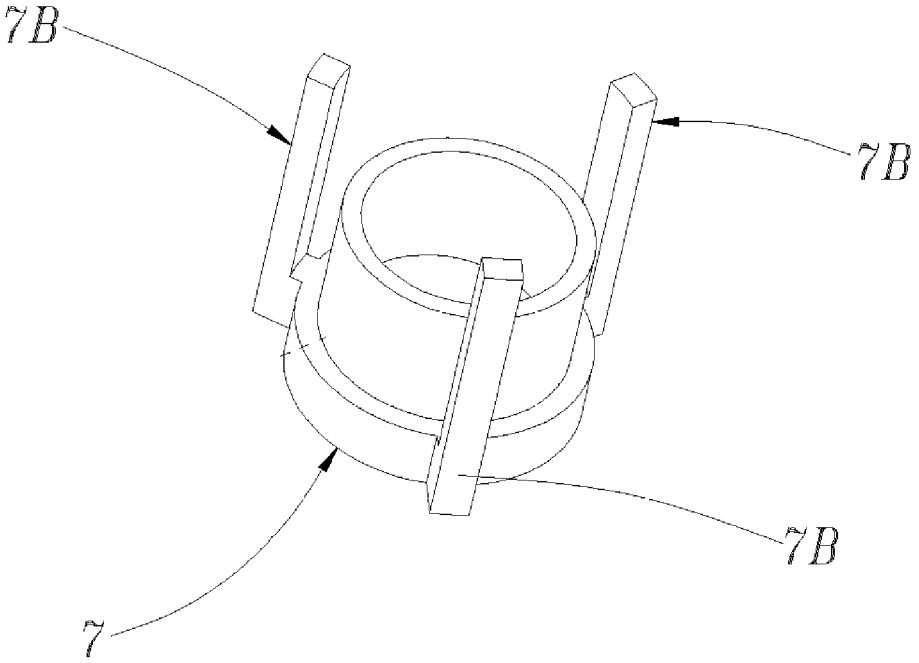
FIG. 2D illustrates a center plug element of the throttling valve of FIG. 2.

An insert rib (see rib 7B in FIGS. 2 and 2D, for example) supports center plug 7 for the cylindrical valve member 5 which forces the flow around the outside circumference at 17 of the cylindrical valve member 5 so that it can be flow controlled at circumferential flow area 13 at the top of the throttling valve member 5. The cylindrical throttling valve member 5 is thus pressure balanced since its upper and lower axial acting pressure surfaces see approximately the same pressure and their axially exposed pressure area is relatively small (see FIG. 2C). The throttling pressure load on the valve member is carried normal (i.e. at an angle of about 90 degrees) to its axis of movement so as to have minimum effect on the pressure responsive member load relative to its bias spring 9.

The valve member 5 may also be used as a shut off valve to shut off flow to the discharge nozzle 3 completely. The bias spring 9 is axially attached to the top of the pressure responsive member 8 and also to the underside of the threaded top or cap 10 of the reference pressure chamber 34. Thus, when the cap 10 is rotated in the threads 36 such that the cap backs up and out of the chamber 34, the bias of spring 9 will be removed from the pressure responsive member 8. As a result, the entire assembly including pressure responsive member 8, the connecting rod 11 and the valve member 5 will be lifted up to close off the flow through the circumferential area at 13, and thus, shut off flow to the nozzle 3. This will allow a user to change the nozzle 3, for example, without getting wet. Further, since the flow to the nozzle 3 may be turned off without shutting off the water supply to the sprinkler itself, the riser 1 will remain popped up and out of the ground such that the nozzle 3 is easily accessible.

Figure 5:
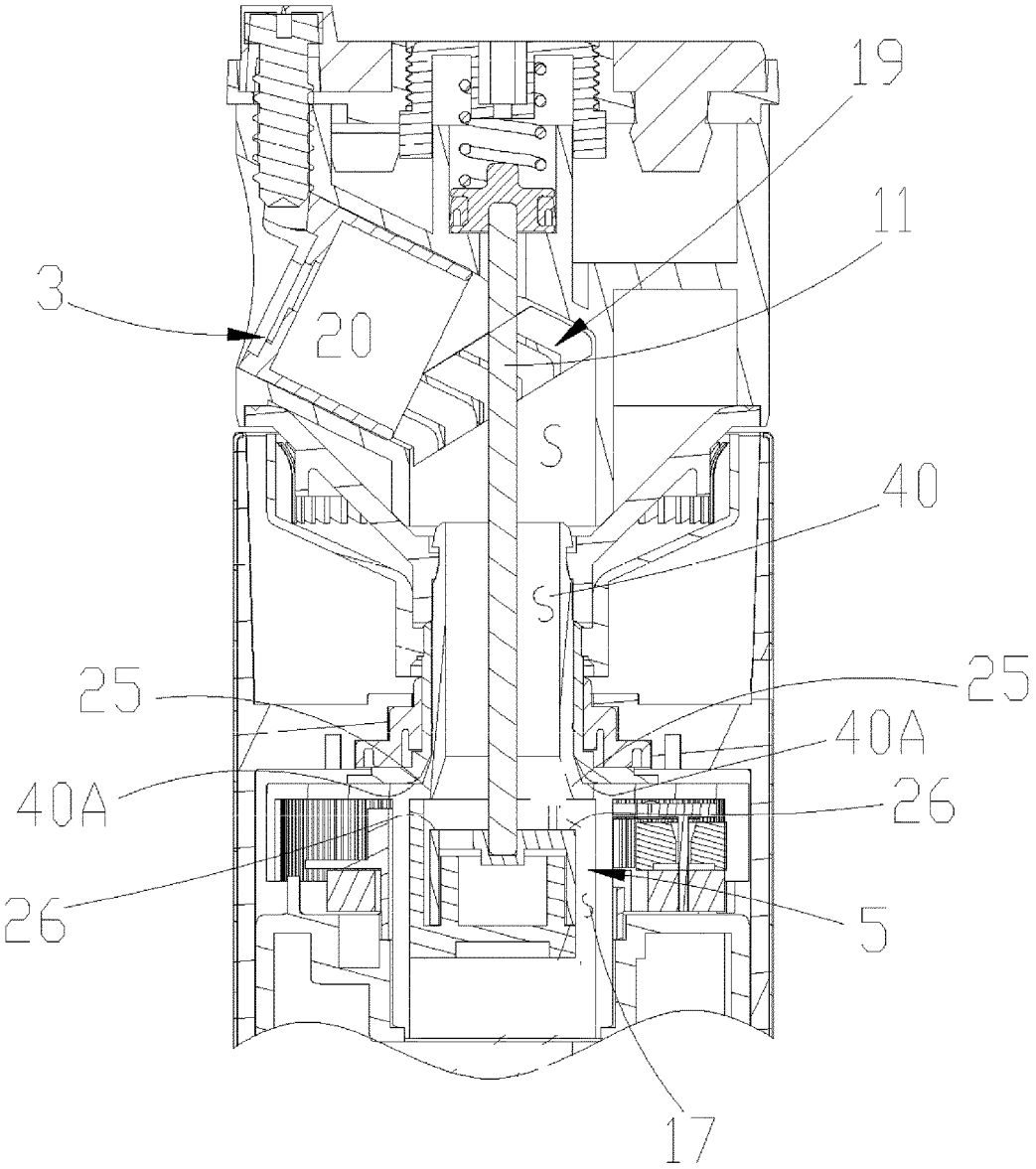
FIG. 5 is an expanded cross sectional line drawing of the upper part of the rotary driven sprinkler of FIG. 1.

The upstream flow throttling valve 5 includes a cylindrical ring 23 supported by ribs 23A with a center ring 11A for connection to the activation shaft 11. See FIG. 2 and FIG. 2C, for example. The lower inside area of this cylindrical sleeve valve member is vented in between its support ribs 23A as shown at 23B. Flow throttling occurs between the top of cylindrical edge 26 (see FIG. 5) of the cylindrical valve member, or ring, 23 and the outside circumference of the nozzle drive shaft center hole area 40 at 40A.

This cylindrical edge 26 opens and closes the flow area 13 between it and the outer diameter 40A of the flow area 40, upstream of the surface 25 through the nozzle drive shaft 14 and has a minimum axially exposed pressure area which is compensated for by pressure applied at its bottom and the cylindrical edge 26. Thus, there is a minimum axial force applied to the connecting shaft 11 and to the pressure responsive piston 8 of the pressure regulator assembly 4 in the upper nozzle housing, which is referred to atmospheric pressure.

Figure 6:
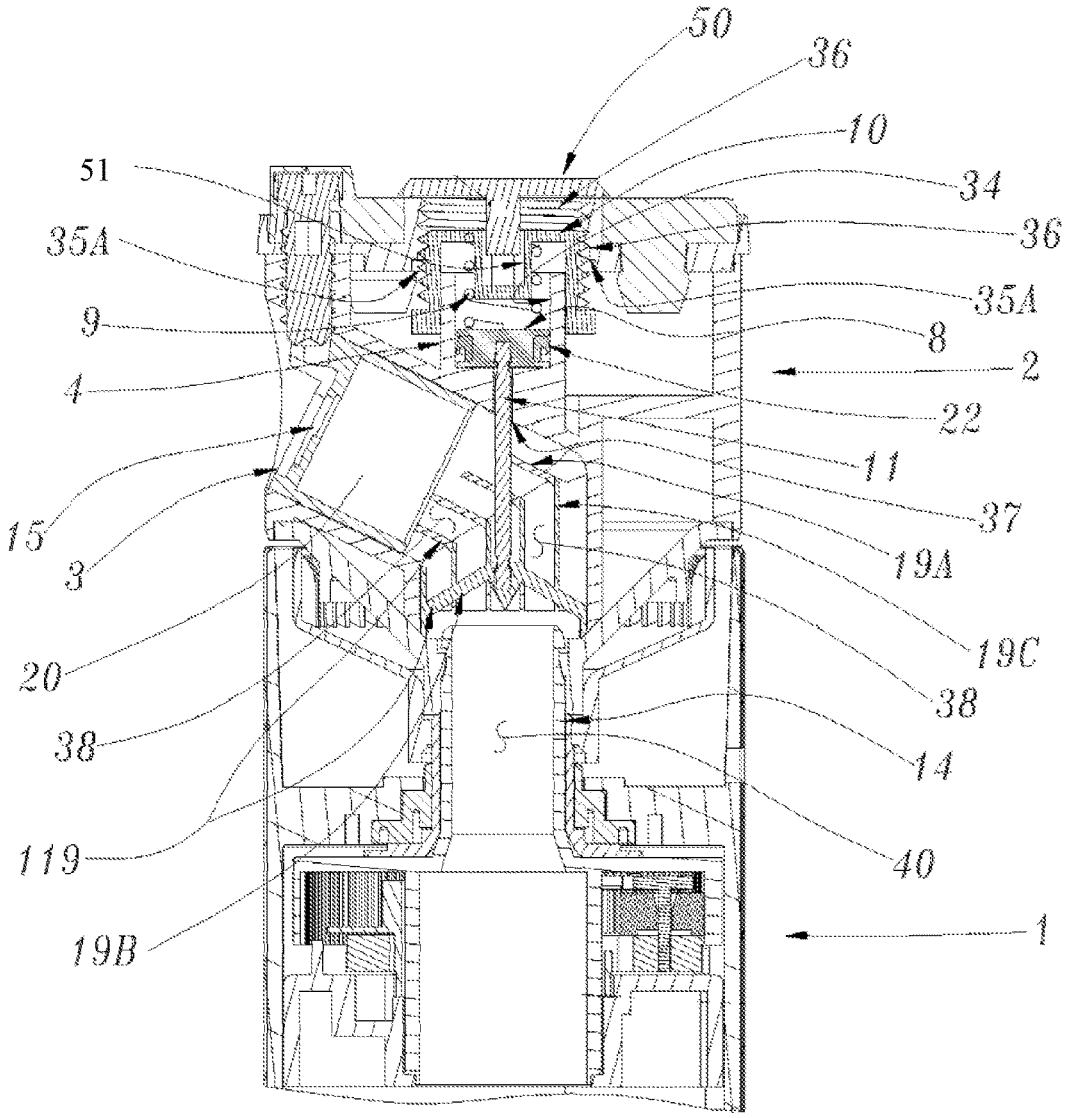
FIG. 6 is an expanded cross-section line drawing of the upper part of the rotary driven sprinkler of FIG. 1 showing the entire nozzle housing assembly and the upper part of the riser with an alternate flow throttling valve configuration in the nozzle housing including a flow turning vane separated into two portions with the lower flow straightener vane part movable axially to interact with the upper turning vane portion to accomplish the flow throttling function with essentially no additional pressure loss or flow components in the sprinkler flow path.

FIG. 6 illustrates an alternate low pressure loss, dirt tolerant configuration of a flow throttling valve 119 which is incorporated on the center axis of the nozzle assembly 2. The throttling valve 119 utilizes the flow turning vane 19, which is shown in FIGS. 1-5 as well, to provide a very low pressure loss throttling valve that is connected with the pressure responsive member 8 of the pressure regulator 4 that includes an atmospheric pressure reference. All components are entirely in the nozzle housing assembly 2.

Figure 9:
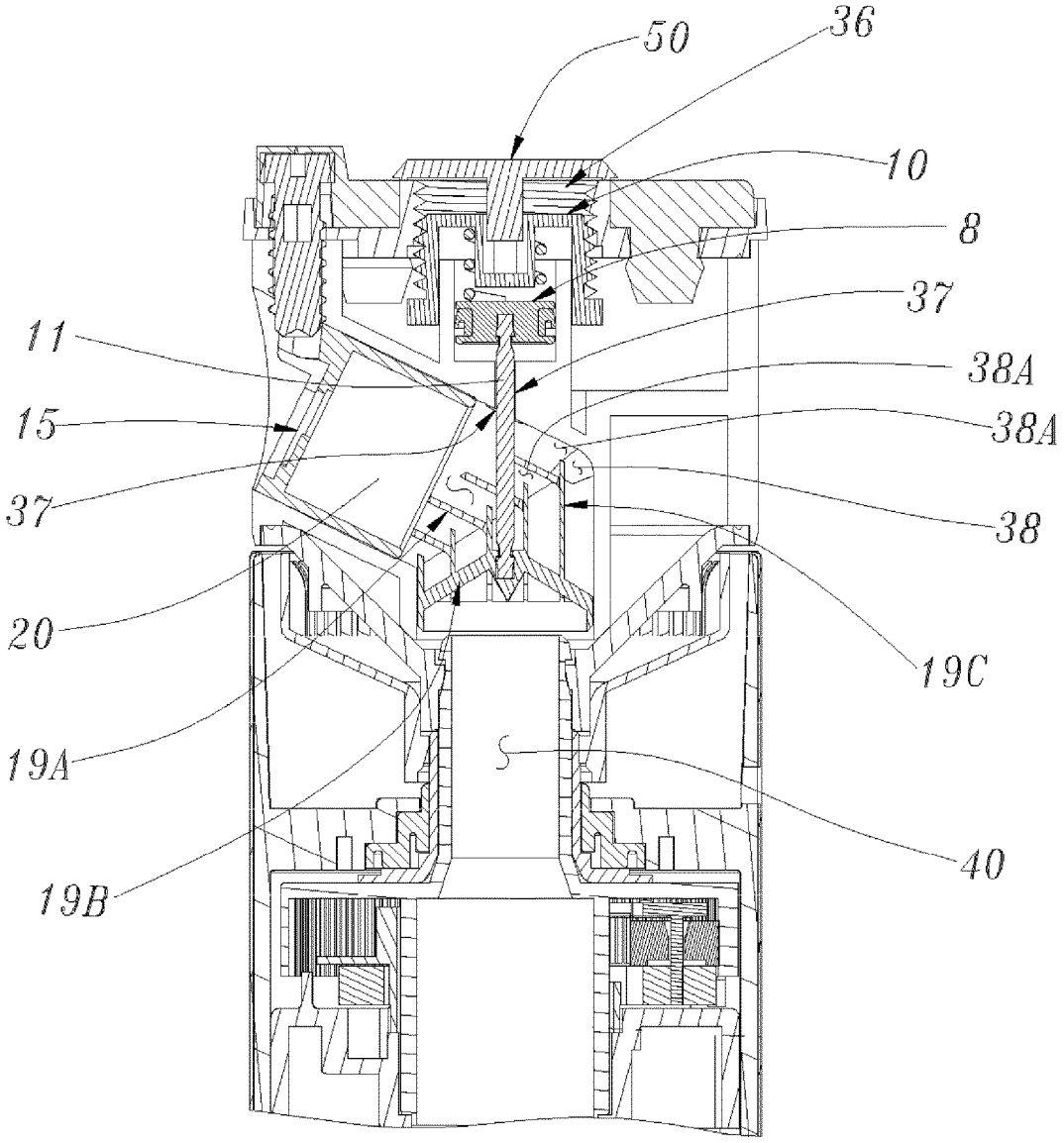
FIG. 9 illustrates an expanded cross sectional view of the upper part of the rotary driven sprinkler of FIG. 6 with the movable lower portion of the throttling valve moved axially upward by its center connection to a shaft connected to the pressure responsive member.
Figure 10:
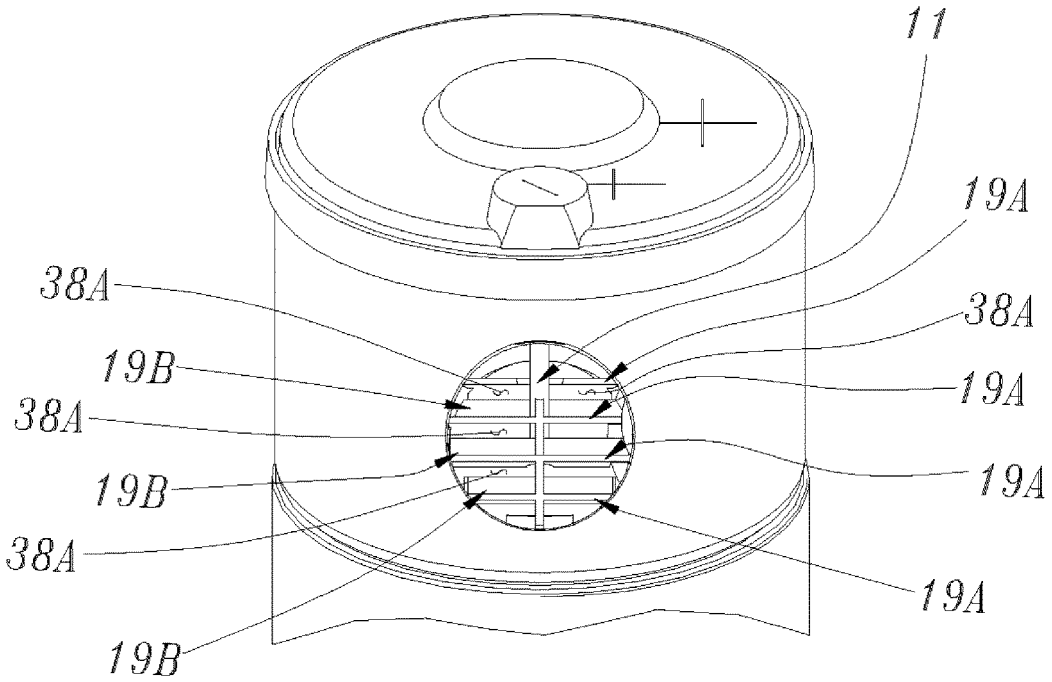
FIG. 10 is a view looking into the nozzle housing through the exit nozzle mounting hole showing the turning vane components of the throttling valve located in the nozzle housing.
Figure 11:
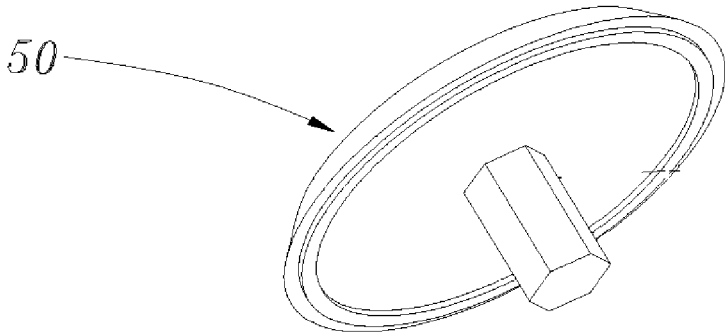
FIG. 11 is a perspective view of a removable dirt cover that also provides for pressure regulator adjustment and which, when removed, allows viewing of an indication of the pressure setting and allows changing the pressure setting, if desired, for range adjustment.

In FIG. 6, the throttling valve 119 is shown in an open state. In FIG. 9, the pressure regulator 4 is shown with its pressure responsive piston 8 moved upward as if responding to an over pressure condition in the direct flow entry area 20 of the sprinkler discharge nozzle 15. This moves pressure responsive piston 8 upward against the preset compression force of the spring 9 and atmospheric pressure as vented into the reference pressure chamber 34. Threads 36 and 35A interact to allow for adjustment of the force of the spring 9 against the pressure responsive piston 8. The lower, movable portion 19B of the valve 119 moves axially with the pressure responsive piston to restrict flow to the nozzle 15.

The area directly upstream of the discharge nozzle 15 is connected to and exposed to the same pressure as the pressure side of the pressure responsive piston 8 via channel 37. The channel 37 connects the inside of the nozzle flow passage 38 to the control cavity 34 of the pressure regulator 4 and pressure responsive piston 8. The connecting shaft 11 extends through this channel 37 with a space or gap between the shaft 11 and a sidewall of the channel 37. The space or gap between shaft 11 and the sidewall of the channel provides a self-cleaning nozzle inlet pressure connection passage and provides for pressure fluctuation stabilization for the pressure regulator's pressure responsive piston 8. The channel 37 provides a path to connect axially moving shaft 11 and moving valve element 19B. A lip seal 22 is provided around the piston 8 to limit dirt access to the channel 37 and into the flow path.

The area immediately upstream of the inlet area 20 of the nozzle 15 is a particularly favorable position for flow throttling which also provides sprinkler range control. As indicated in FIG. 9 at 38A, flow velocities are increased by the flow restriction imposed by the ribs 19C of the axially movable valve element 19B. When the valve element 19B moves axially, the ribs 19C extend up over the ends of the vanes 19A of the top part of the valve 119. The axial movement of the ribs 19C restricts flow in the turning vane pass flow area 38. FIG. 6 shows this area fully open with the vanes 19A and ribs 19C acting as a minimum pressure loss flow turning vane 19. FIG. 9 illustrates the movable valve member 119 in a partially closed position to limit flow to the inlet area 20.

The upstream flow restriction causes an increase in velocity shown at 38B through the area 38A of the now throttled flow control valve 119. See FIG. 9. This increased velocity is an entry velocity to the discharge nozzle area 15 and adds to the nozzle discharge velocity and stream energy so that the nozzle produces improved stream break-up and uniformity of distribution even at reduced flow rates. That is, providing the flow throttling just upstream of the nozzle 15 in the nozzle housing 2 helps to maintain stream uniformity even when flow rates are reduced.

The components in the nozzle housing 2 may be used to provide throttling for range control. The cap 50 may be removed and also used to access a hexagon shaped or slot shaped hole 51 (FIG. 6) in the top member 10 and to turn the threaded top member 10. Turning the top member 10 to move it up provides less compression force by spring 9 of the pressure regulator 4 on pressure responsive member 8 to reduce range. Moving the top 10 downward to increase the force of the spring 9, causes the throttling valve member 19B to move down to be more open such that flow is maximized.

Removing the dirt cover 50 allows a user to see the number of threads 36 that are exposed above the top 10. If the thread pitch (height between thread points) is adjusted or set relative to the spring rate force change per unit length of the spring 9, the threads may be used as an indication of the force applied by the top 10. For example, each thread peak exposed may represent a 15 psi change in the pressure set by the top 10. That is, if calibrated, the thread count may be used to indicate the precise pressure being applied by the top 10 as well as the amount that this force has been adjusted by rotation of the top 10.

The top 10 may also be used as a range setting screw that ensures that the sprinkler produces the desired range for its location in an irrigation system over a range of supply pressure functions.

Figure 7:
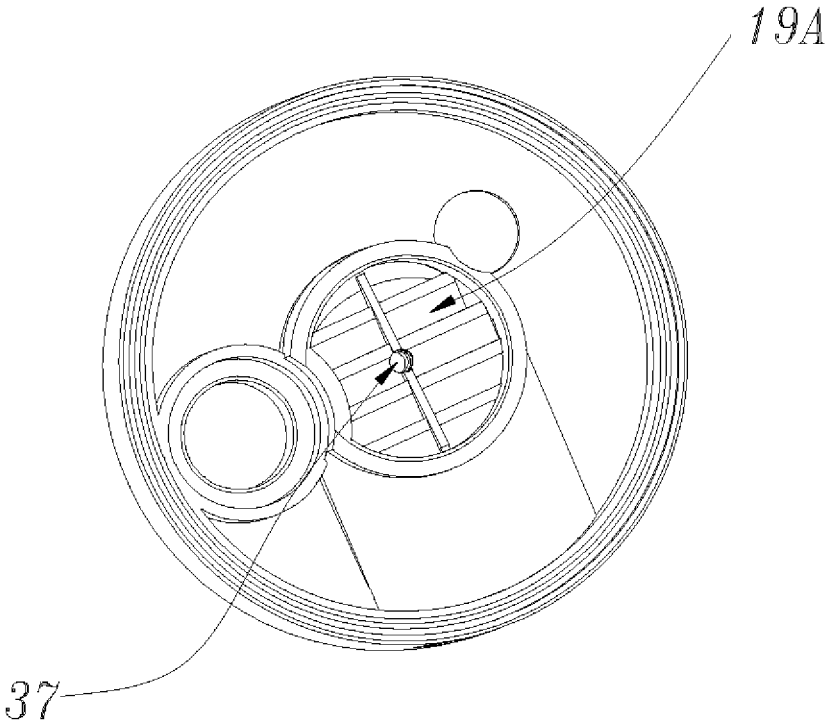
FIG. 7 is a perspective view looking up into the bottom of the nozzle housing through its drive shaft flow supply entry at the axially movable lower portion of the flow throttling valve member removed.
Figure 8:
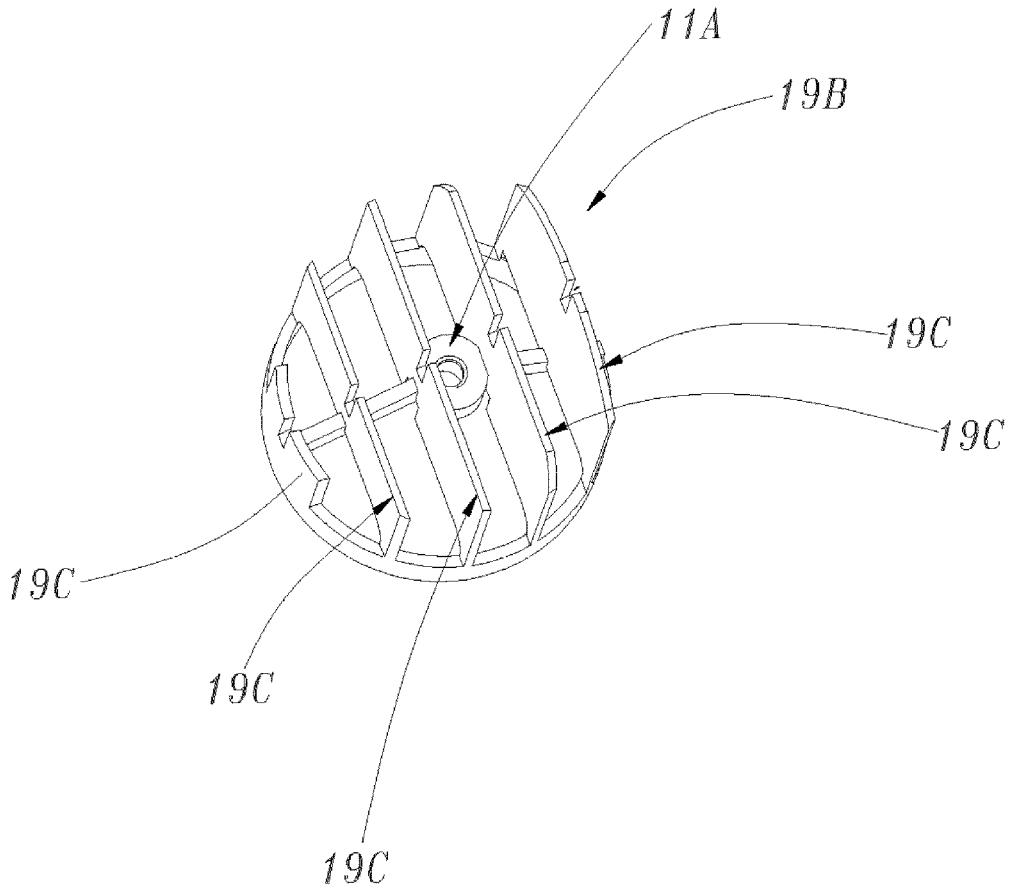
FIG. 8 is a perspective view of the movable lower portion of the flow throttling valve member.

FIG. 8 shows a perspective view of the axially movable throttling valving member 19B. The movable valve member 19B includes a structural lower outer ring positioned out of the flow path and vertical vanes 19C, which move upward over the ends of the turning vanes 19A to limit flow. The vanes 19A are illustrated in the nozzle housing inlet nozzle drive shaft hole in FIG. 7. In this figure, the movable valve member 19B has been removed.

The functional assembly of the pressure regulator 4 and throttling valve assembly is shown in FIG. 6. Pressure throttling is shown in FIG. 9 where the pressure regulating and flow throttling components are shown in a pressure controlling throttling position.

Although the present invention has been described in relation to particular embodiments thereof, many other variations and modifications and other uses will become apparent to those skilled in the art.

What is claimed is:

1. A sprinkler assembly comprising:

a riser in fluid communication with a water supply including a flow path for water provided to the sprinkler assembly from the water supply;

a nozzle assembly rotatably mounted on the riser and in fluid communication with the riser, the nozzle assembly including:

a center flow passage in fluid communication with the flow path of the riser;

a nozzle mounted in the nozzle assembly and in fluid communication with the center flow passage, the nozzle configured to direct water out of the nozzle assembly; and a pressure regulator provided in the nozzle assembly and configured to maintain a desired pressure at an inlet area of the nozzle; and a throttling valve provided in the nozzle assembly and operably connected to the pressure regulator to selectively reduce flow to the nozzle when pressure at an inlet of the nozzle exceeds a reference pressure.

2. The sprinkler assembly of claim 1, wherein the pressure regulator further comprises:

a reference pressure chamber configured to maintain the reference pressure related to the desired pressure;

a pressure responsive member movably mounted in the reference pressure chamber;

a biasing member, positioned in the reference pressure chamber and configured to apply a predetermined biasing force on the pressure responsive member; and a movable member secured to the nozzle assembly and movable into the reference pressure chamber to modify the biasing force of the biasing member.

3. The sprinkler of claim 2, further comprising:

a connecting rod connected at a top end to the pressure responsive member and to the throttling valve at a bottom end thereof such that the connecting rod and a movable valve element of the throttling valve are movable with the pressure responsive member to adjust the flow of water to the nozzle.

4. The sprinkler of claim 3, wherein a top surface of the pressure responsive member is exposed to the reference pressure chamber and a bottom surface of the pressure responsive member is exposed to the inlet area of the nozzle.

5. The sprinkler of claim 2, wherein the movable member further comprises an opening configured to expose the reference pressure chamber to atmospheric pressure, such that the reference pressure is substantially atmospheric pressure.

6. The sprinkler of claim 3, wherein the throttling valve further comprises:

a first element positioned immediately upstream from the nozzle; and a second element positioned immediately upstream from the first element and connected to the connecting rod such that the second element is movable relative to the first element between an open position where the second element has substantially no effect on flow to the nozzle and a closed position in which the second element impedes flow to the nozzle.

7. The sprinkler of claim 6, wherein the nozzle assembly includes a flow path, the flow path including a straight portion in fluid communication with the flow path of the riser and an angled portion positioned downstream of the straight portion where the movable valve element is mounted in the straight portion of the flow path.

8. The sprinkler of claim 7, wherein the first element of the throttling valve is positioned in the angled portion of the flow path in the nozzle assembly.

9. The sprinkler of claim 6, wherein the biasing member is removable from the reference pressure chamber entirely such that the throttling valve is pushed up by water pressure into a throttling position to stop the flow of water to the nozzle.

10. The sprinkler assembly of claim 1, wherein the nozzle is removably mounted in the nozzle assembly.

11. A sprinkler assembly comprising:

a riser in fluid communication with a water supply including a flow path for water provided to the sprinkler assembly from the water supply;

a nozzle assembly rotatably mounted on the riser and in fluid communication with the riser, the nozzle assembly including:

a center flow passage in fluid communication with the flow path of the riser;

a nozzle mounted in the nozzle assembly and in fluid communication with the center flow passage, the nozzle configured to direct water out of the nozzle assembly; and a pressure regulator provided in the nozzle assembly and configured to maintain a desired pressure at an inlet area of the nozzle, based on pressure in the nozzle assembly; and a throttling valve provided in the nozzle assembly and operably connected to the pressure regulator in the nozzle assembly via a connecting rod to selectively reduce flow to the nozzle when pressure at an inlet of the nozzle exceeds a reference pressure.

12. The sprinkler assembly of claim 11, further comprising a drive shaft connecting the nozzle assembly to the riser, wherein the flow path of the nozzle is formed in the drive shaft.

13. The sprinkler assembly of claim 12, wherein the pressure regulator further comprises:

a reference pressure chamber configured to maintain a reference pressure related to the desired pressure;

a pressure responsive member movably mounted in the reference pressure chamber;

a biasing member, positioned in the reference pressure chamber and configured to apply a predetermined biasing force on the pressure responsive member; and a movable member movable into the reference pressure chamber to modify the biasing force of the biasing member.

14. The sprinkler assembly of claim 13 wherein the connecting rod is connected at a top end to the pressure responsive member and movable with the pressure responsive member.

15. The sprinkler assembly of claim 13, wherein the biasing member is removable from the reference pressure chamber entirely and the movable member is movable upward and downward to set a position of the throttling valve such that flow to the nozzle is set at a desired rate.

16. The sprinkler assembly of claim 6, wherein the biasing member is removable from the reference pressure chamber entirely and the movable member is movable upward and downward to set a position of the second element such that flow to the nozzle assembly is set at a desired rate.

17. The sprinkler assembly of claim 6, wherein the movable member is operatively connected to the connecting rod such that movement of the movable member upward and downward provides flow control and throttling to the nozzle assembly.

* * * * *